United States Patent [19]

Dunham

[11] 3,980,342

[45] Sept. 14, 1976

[54] AUGER TYPE MINING MACHINE

[76] Inventor: George A. Dunham, Rte. 2, Box 155-C, Beckley, W. Va. 25801

[22] Filed: Apr. 9, 1975

[21] Appl. No.: 566,321

[52] U.S. Cl. ..... 299/56; 173/35; 173/148

[51] Int. Cl.[2] ..... E21C 27/22

[58] Field of Search ..... 299/55, 56, 57; 173/35, 173/148, 149, 150, 151, 165; 175/122, 195

[56] References Cited

UNITED STATES PATENTS

| | | | |
|---|---|---|---|
| 1,653,111 | 12/1927 | Lobbey | 299/55 |
| 1,728,914 | 9/1929 | Berry | 173/35 X |
| 2,634,950 | 4/1953 | Allen | 173/150 |
| 2,940,740 | 6/1960 | Adams | 299/57 |

FOREIGN PATENTS OR APPLICATIONS

| | | | |
|---|---|---|---|
| 1,117,067 | 11/1955 | Germany | 173/160 |
| 12,997 | 12/1890 | United Kingdom | 173/148 |

*Primary Examiner*—Ernest R. Purser
*Attorney, Agent, or Firm*—Cushman, Darby & Cushman

[57] ABSTRACT

An auger type mining machine in which the rotational torque necessary to do the mining is supplied separately and independently from the force required to advance the auger, and is provided by a motor having a stator portion insulated from, secured to and contained within a casing and disposed in concentric relation to the auger, and a rotor portion of the motor insulated from and attached to an inner drive member which is also disposed circumferentially about the auger in driven relationship to the stator portion of the motor. The force required to advance the auger is supplied through a thrust member which is movable between a rearwardmost position which is at least one auger length from the rearmost portion of the auger drive, and a forward position which is at least as far forward as the rearmost portion of the auger drive so that when the thrust member is in the rearmost position an additional auger section may be attached to the rear of the previously inserted auger section and fed through the auger drive means by the thrust member.

22 Claims, 9 Drawing Figures

AUGER TYPE MINING MACHINE

BACKGROUND OF THE INVENTION

1. Field of the Invention

This invention relates to an auger type mining machine used for mining coal and the like, and more particularly, to an auger type mining machine in which sections of auger can be added to the rear portion of the auger in order to extend the drilling distance into the vane of material being mined.

2. Prior Art

Auger type mining machines, particularly those in which short length of auger may be added to the rear portion of the entire auger unit as a seam is being mined, have found considerable favor in the industry and many machines for utilizing sectioned augers have been designed. It is very common for auger type mining machines to utilize a drive unit which attaches to a centrally located shaft in the auger. The power unit is usually designed to provide both the torque necessary to be transmitted to the cutting head to do the mining operation, as well as the necessary advancement in order to keep the cutting head against the face of the seam of material being mined.

The use of a single source for transmitting both the torque and advancement of the auger presents many problems associated with prior art devices. By transmitting the torque through a central shaft in the auger some misalignment and wobbling of the auger will naturally occur due to the inherent bending of such a shaft when torqued by application of a rotational force directly to the rear end of the shaft. In addition, because of the relatively small diameter of the shaft in relation to the overall diameter of the auger and the necessary forces to be transmitted, a substantial amount of power must be utilized to apply the torque to such a small radius arm as that presented by the rear portion of the shaft itself.

Another problem associated with applying both the torque and forward advancement of the augers through a single power unit is the necessary coordination between the rotation and advancement of the auger in order to keep the cutting head adjacent the face being mined. As is the case with many prior art machines of this type the power supplying unit itself is advanced forward towards the surface of the wall so as to maintain the auger in proper relation to the surface being mined. Such as system usually requires a very complicated mechanically coordinated movement between the movement of the auger and the forward movement of the power unit, thus making this portion of the mining apparatus one of the more expensive portions.

SUMMARY OF THE INVENTION

The present invention overcomes the above disadvantages associated with prior art devices by providing an auger type mining machine in which the rotational torque necessary to do the mining is supplied separately and independently from the force required to advance the auger, thus making the device considerably less complicated and as a result, less expensive.

The rotational torque is supplied through a power unit disposed circumferentially about the auger and which transmits torque to the auger through gripping means, to the outer spiral peripheral portion of the auger to supply the torque therethrough rather than through the central shaft as is the case with prior art devices. Further, this auger advancing means is disposed stationary with respect to the surface being mined and therefor the complicated and bulky mechanism used with prior art devices to advance with power unit is not required.

Likewise, since the auger advancing means does not have to supply the rotational torque necessary for cutting action, it can be relatively less bulky and of substantially simpler design. A simple variable speed gear motor can be used to supply the necessary advancing movement through a shaft secured to a thrust bearing which applies the advancing force to the rear portion of the rear most auger section. This permits ease of adjustment of the advancement speed relative to the rotational torque being supplied by the auger drive means so that, depending upon the material being mined, the rate of advancement of the auger and cutting head relative to the surface to which it is to be maintained in contact with, can easily be adjusted.

For ease of portability and in setting up the apparatus adjacent a surface to be mined, the basic frame structure is designed to be separable from the auger drive means in such a manner to permit the two to be easily and quickly assembled or disassembled within an underground mine entry.

The auger drive means is preferably designed in the form of a large electric motor in which the rotor portion is secured to an internal member having gripping means associated with the inside surface thereof to contact the spiral portion of the auger and transmit the necessary rotational forces. The stator portion of the electric motor is then contained within an outer casing portion which likewise surrounds the auger. Preferably secured to the external portions of the casing are a plurality of adjustable mounting means which can be adjusted to place the auger in proper alignment with the surface to be mined so that the bore hole will be straight. In addition, the mounting means are capable of wedging the upper portion of the casing or wedge members associated therewith against the roof of the mine entry so that the unit will be wedged between the floor and the roof, thus preventing movement of the unit during the mining operation.

The frame structure which houses the auger advancing means likewise has adjustable bracing means attached thereto to wedge the frame structure between the roof and floor of the mine to provide additional support. Since the front portion of the frame structure is preferably secured to the rear portion of the casing, it is only necessary to have an adjustable bracing means attached to the rear portion of the frame structure to provide this added support. However, any desired amount of bracing may obviously be provided in a variety of ways. Also, in addition to the variable speed motor which supplies the auger advancement, a plurality of threaded members at least two of which are horizontally spaced across the width of the frame structure, preferably at a distance greater than the diameter of the auger, are used to support the thrust bearing and support plate so that even pressure is applied across the entire rear face of the rear most auger section. This aids in maintaining proper alignment of the auger as it is advanced into the seam.

Although any one of a number of gripping means can be provided on the internal portion of the auger drive means, it is preferable to use a cylindrical surface with regularly spaced discontinuities which mate to like regularly spaced discontinuities designed into the auger sections being used. This permits uniform application of the rotational torque to the auger as well as permitting the auger to be easily advanced through the auger drive means by the auger advancing means.

DETAILED DESCRIPTION OF THE PREFERRED EMBODIMENT

The auger type mining apparatus of the present invention is composed of three basic parts: a frame structure designated generally as 10, an auger drive means designated generally as 12, an auger advancing means designated as 14.

Figure 4:
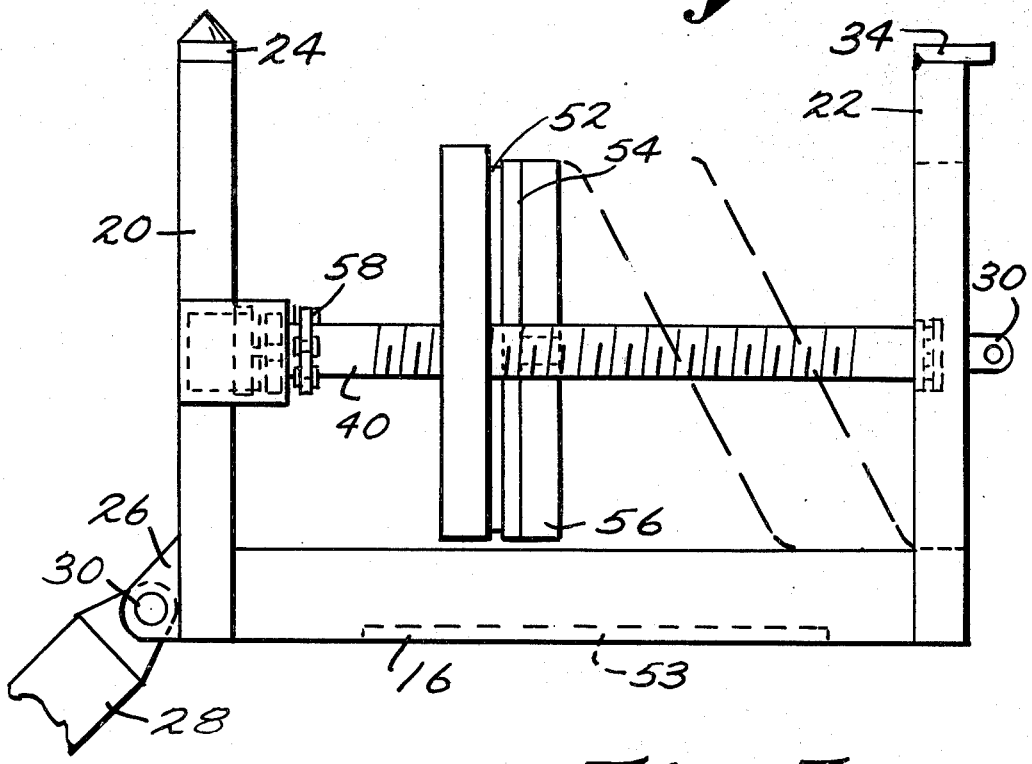
FIG. 4 is a side view of the frame structure and auger advancing means of the preferred embodiment.
Figure 5:
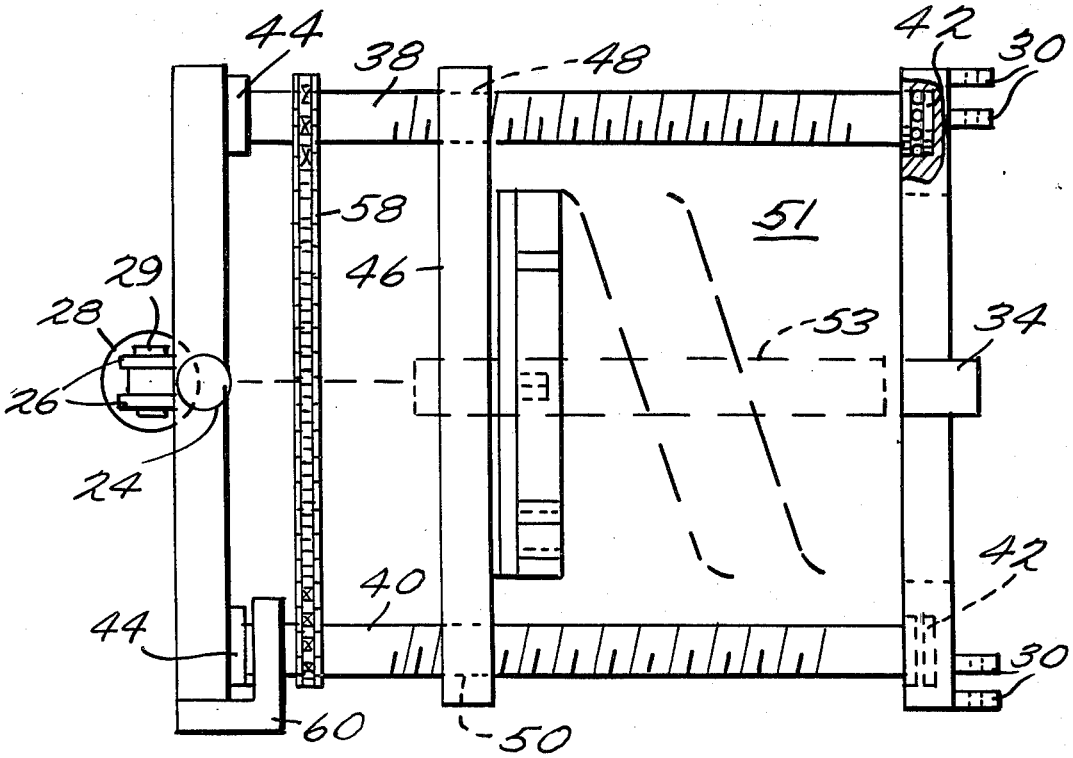
FIG. 5 is a top plan view of the frame structure and auger advancing means shown in FIG. 4.

Referring first to the basic frame structure 10, as best shown in FIGS. 4 and 5, it is composed basically of two horizontally spaced support members 16 and 18, only one of which 16 is visible in FIG. 4, the other 18, being disposed directly horizontally behind 16 and on the opposite side of frame structure 10. Secured to the ends of horizontal support members 16 and 18 are vertical support members 20 and 22, both of which are generally rectangular in shape and are fabricated preferably from rectangular stock of sufficient wall thickness to provide the necessary support and rigidity. The vertical support members are horizontally spaced apart a sufficient distance to permit an auger section to be laterally passed therebetween so that it can be attached to the rear portion of the next preceding section which has been fed forward into the auger drive means. This spacing must include a sufficient distance to place the auger section in the desired position while the auger drive means has the thrust applying member position at its rear most location.

Vertical support member 20 is preferably a weldment made of rectangular cross sectional stock, which in turn is welded to the horizontal support members 16 and 18 at the rear end thereof. At the upper rear portion of vertical support member 20 is secured a wedge member 24. At the bottom portion of vertical support member 20 is attached a bracket 26 which provides a yoke through which an adjustable bracing means 28 can be pivotally mounted as, for example, by use of pin 29. Since only one adjustable bracing means 28 is used on the rear portion of the frame structure 16, it is essential that it only be permitted to pivot in the vertical direction. Otherwise, the frame would have the tendency to rock to either side and not provide the desired rigid support. Use can be made of this single point support, however, as a result of the additional adjustable bracing means associated with the auger drive means 12, to be described below.

Figure 1:
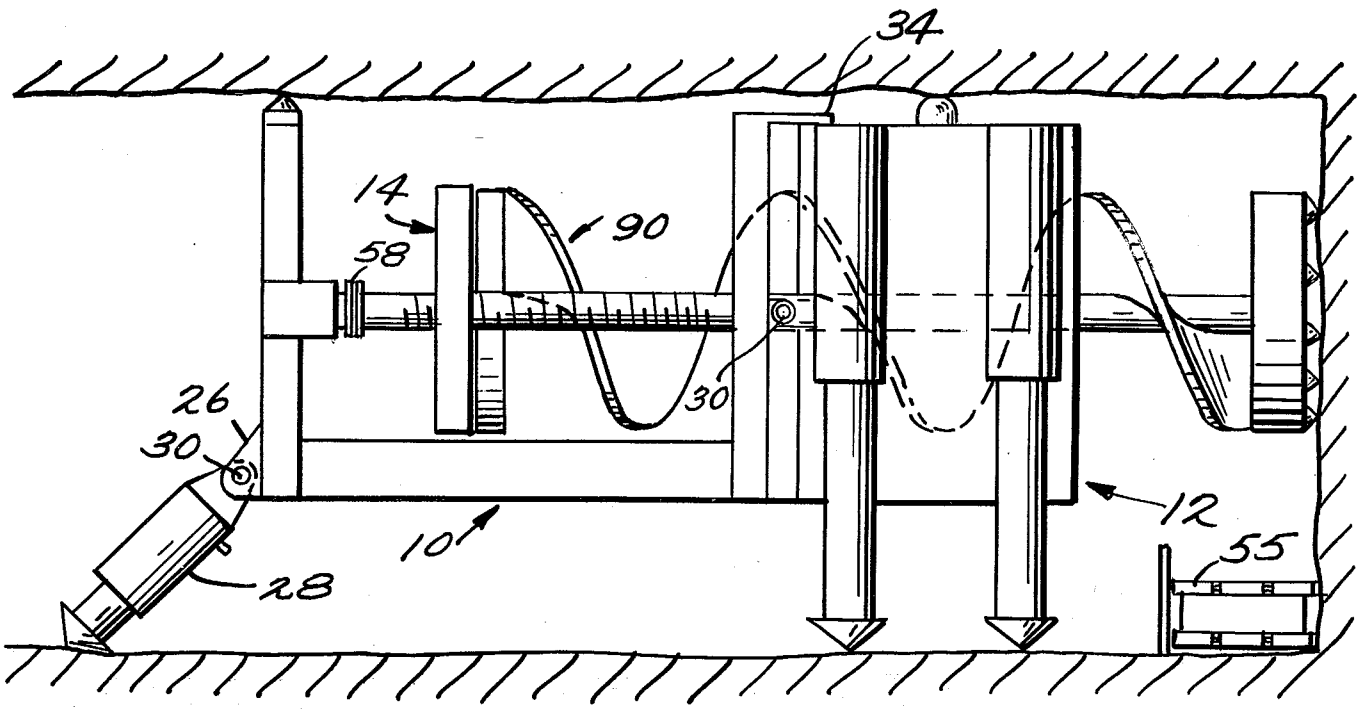
FIG. 1 is a side view of the preferred embodiment of the present invention as shown supported inside a mine entry with the cutting head adjacent the surface to be mined.
Figure 3:
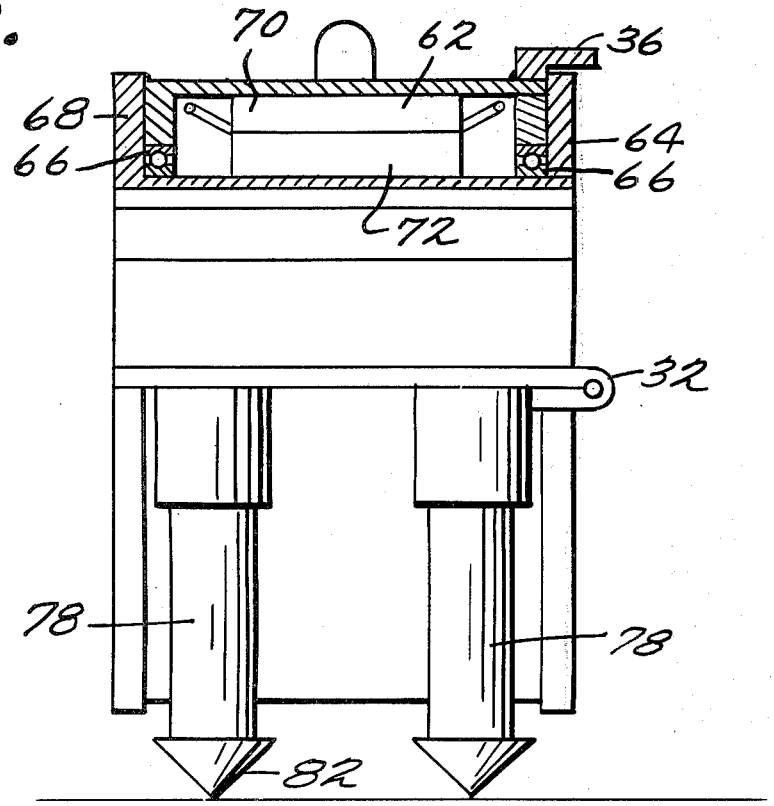
FIG. 3 is a side view in partial cross section taken along line 3—3 of the auger drive means shown in FIG. 2.

The forward vertical support member 22 is fabricated in a manner similar to that of support member 20 and, in addition, is provided with means for securing the frame structure to the auger drive means 12. This is preferably accomplished by use of a pin and clevice arrangement. To this end, brackets 30 are welded to each side of the vertical support member 22 in approximately the mid portion of the vertical direction thereof. These are designed to mate with a corresponding bracket 32 on auger drive means 12, as shown in FIG. 3. When the two units, i.e. frame structure 10 and auger drive means 12, are assembled, the bracket 32 is placed between brackets 30 on each side of the frame and auger drive means and then a self-locking pin (not shown) is inserted through the aligned holes in the brackets to maintain the frame structure 10 in proper relation to the auger drive means 12 as is shown in FIG. 1.

In addition, a spacer and alignment member 34 is secured to the top of the forward vertical support member 22 and a corresponding spacer and alignment member 36 is secured to the upper portion of the auger drive means 12 to permit proper alignment to the two portions of the device and in combination with the pin and clevice arrangement discussed above, provide the rigidity and support necessary between the two units. This is accomplished by having the outer most surfaces of alignment members 34 and 36 be in abutting relation when the pin and clevice arrangement are secured together, thus giving a three-point support to provide the desired rigidity.

Mounted for support between the vertical support members 20 and 22, are threaded shafts 38 and 40. The shafts are mounted in bearings 42 and 44 at opposite ends of each thereof, to permit the shafts to freely rotate. A thrust plate 46 is supported by shafts 38 and 40 through threaded openings 48 and 50 in which are machined threads which mate with the threads on the shafts. Secured to thrust plate 46 is one race of a thrust bearing 52 and the other race of the bearing is adapted on its outer face 54 to abut the rear portion 56 of an auger section which has previously been placed in position and secured to the overall auger unit in a manner to be described below.

Shafts 38 and 40 are interconnected and driven preferably by a chain linkage 58 with a mating gear either secured to or forming an integral portion with shafts 38 and 40. A variable speed gear motor 60 is secured to the rear vertical support member 20 and has an output gear associated with shaft 40 to provide the driving power for the auger advancing means. The gear motor is designed to provide a variable speed, high-torque so as to permit proper adjustment of the forward movement of the auger relative to the rotational speed of the auger drive means 12, in a manner more fully set out below.

Also mounted between horizontal support members 16 and 18 and vertical support members 20 and 22, beneath the auger sections is a spillage catching plate 51, preferably in the form of a V-shaped trough with a slot 53 cut in the center portion of the plate to permit the small portion of coal or other material being mined which is not dropped on the conveyor 55 at the face of the vane being mined, to be collected below the frame structure after the material releases from the auger.

Figure 2:
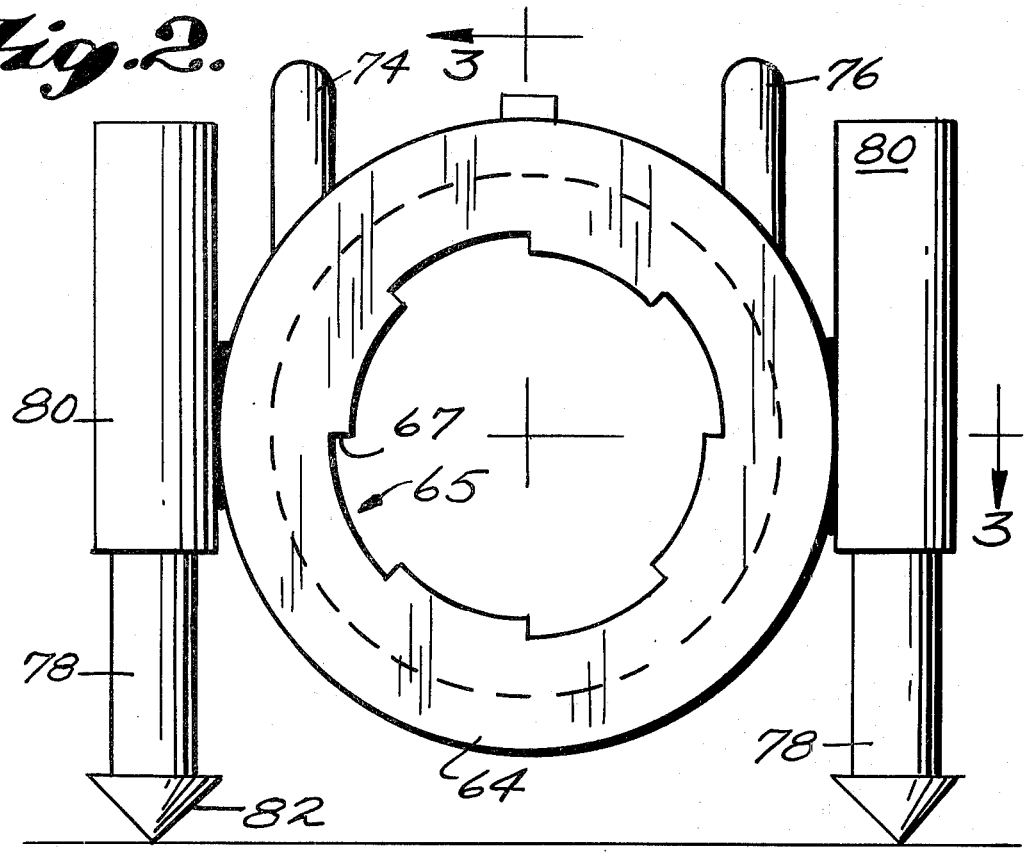
FIG. 2 is a front view of the auger drive means and adjustable bracing means attached thereto of the preferred embodiment.

Referring now to the auger drive means which is best described in connection with FIGS. 2 and 3, an outer casing 62 is provided which surrounds and encloses the entire central section of the auger drive means and provides the points of attachment, such as bracket 32, and spacer and alignment member 36, for connection to and alignment with the frame structure 10. The outer casing 62 is concentric with the auger as is the inner driving member 64 which is supported by outer casing 62 by means of bearings 66 positioned at the outer portions on each side of the inner driving member. A portion 68 of inner driving member 64 extends outwardly beyond the bearings and the mating portions of outer casing 62 so as to be generally in sealing engagement therewith, thus, preventing the introduction of foreign matter into the motor means, to be described below, which is contained within the outer casing.

Secured to but insulated from outer casing 62, is positioned the stator portion 70 of an electric motor which extends completely around the inside of casing 62 in concentric relation to the inner driving member 64. Likewise, a rotor portion 72 of an electric motor is secured and insulated from inner driving member 64 and extends completely around the inner driving member in spaced relation to the stator portion 70.

An example of acceptable design parameters for the motor produced by the stator portion 70 and rotor portion 72 are generally that the internal diameter of the rotor winding be approximately 42 inches and that the width of the stator and rotor be approximately 24 inches, with the motor having 44 poles with consequent pole winding, which is intended to produce a synchronous speed of approximately 163 rpm and a full load speed of approximately 150 rpm and delivering 20,000 foot pounds of torque with a calculated horsepower of 570. It is to be understood that these are merely examples of parameters which may be utilized to provide the desired torque and can well be varied considerably depending upon the desired application of the device, including efficiency and size considerations. The design of any such motor is considered to be within the scope of one skilled in the art of designing electric motors of this size and general utility, therefore, no detailed explanation is believed to be necessary of the exact manner of constructing such a motor. Also, the motor should be equipped with controls for permitting the speed to be varied so as to vary the cutting rate of the auger.

Secured to the upper portion of outer casing 62 are wedge members 74 and 76 which are designed to permit the casing to be secured in relation to the mine shaft being mined in a manner similar to that described in connection with wedge member 24 and the associated adjustable bracing means 28. In that regard, additional adjustable bracing means 78, all of which are essentially identical, have their housing portions 80 secured to opposite sides of the outer casing 62 with a sufficiently rigid connection to provide support therefor and to transmit the desired wedging action to wedge member 74 and 76. These adjustable bracing means as is intended for adjustable means 28, are preferably electric or hydraulic cylinders which can be adjusted through electronic or hydraulic circuit means, respectively, in a known manner so as to permit the auger to be properly aligned in relation to the face of the entry being mined and also to permit the wedge members 74 and 76 to be wedged against the roof of the mine entry to provide the necessary support. The wedge-shaped base portions 82 of each adjustable bracing means 78 are designed to provide the necessary wedging action on the floor of the mine without permitting any movement once the assembly is in position.

The internal cylindrical surface of inner driving member 64 which is intended to transmit torque to the auger sections preferably contains gripping means preferably in the form of a plurality of spaced radial discontinuities 65 which, in essence, are stepped portions that provide a surface 67 which mates with a corresponding surface on the auger sections so as to transmit the torque. Although, obviously the exact shape of the discontinuities can be substantially varied or, for that matter, some other form of gripping means can be provided, it is essential that any such gripping means provide (1) some means of permitting torque to be applied to the auger sections in the radial direction while (2) permitting the auger sections to be continuously and simultaneously advanced through the auger drive means 12 by the auger advancing means 14.

Figure 7:
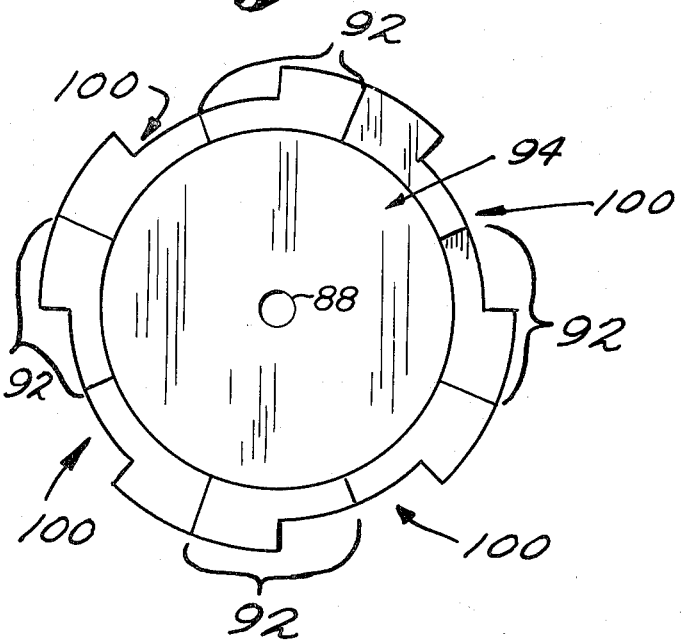
FIG. 7 is a cross sectional view of the auger section shown in FIG. 6.
Figure 8:
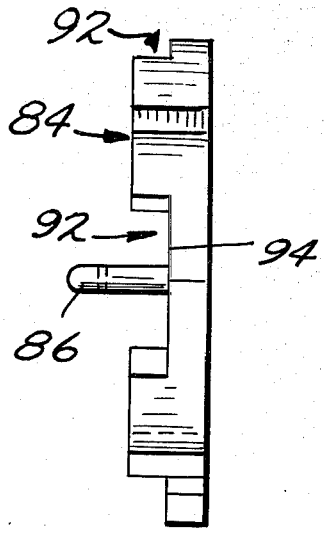
FIG. 8 is a side view of an end portion of the auger section shown in FIG. 6.
Figure 9:
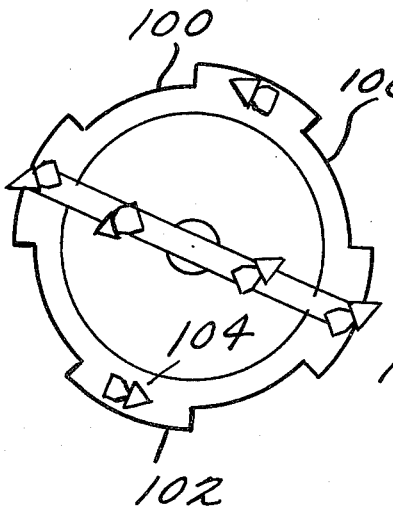
FIG. 9 is an end view of the cutting head of the preferred embodiment.

Turning to a description for the preferred form of the auger to be utilized in connection with this preferred embodiment, reference will be made particularly to FIGS. 6—9. As is the case with conventional augers which are intended to be added to in sections, a single section is provided with male and female mating portions on opposite ends thereof so as to mate with a related portion on another auger section. In the preferred form of auger for the present invention, the male end section 84 as shown in FIG. 8, has a central post 86 which mates with a corresponding opening 88 as shown in FIG. 7, in the female end of an auger section 90. In addition, to provide an interlocking relationship between male and female end portions of adjacent auger sections, axial discontinuities such as are presented by cut out portion 92 permit the male and female end portions to be intermeshed so that torque will be passed between subsequent auger sections. The central region 94 of either end of an auger section can be reduced in thickness to a point where it will still provide the necessary strength to the entire end section so as to permit the transmittal of the torque therethrough.

The present embodiment of auger section is illustrated with a central shaft 96 extending through the entire length of the section, but in view of the fact that neither the thrust which advances the auger to maintain it in proper relation to the surface being mined, or the torque which provides the necessary cutting force, are applied directly to this central shaft, it could therefore be eliminated, thus, permitting an auger section having only a spiral envelope such as 98, without the central shaft 96, to be utilized.

Figure 6:
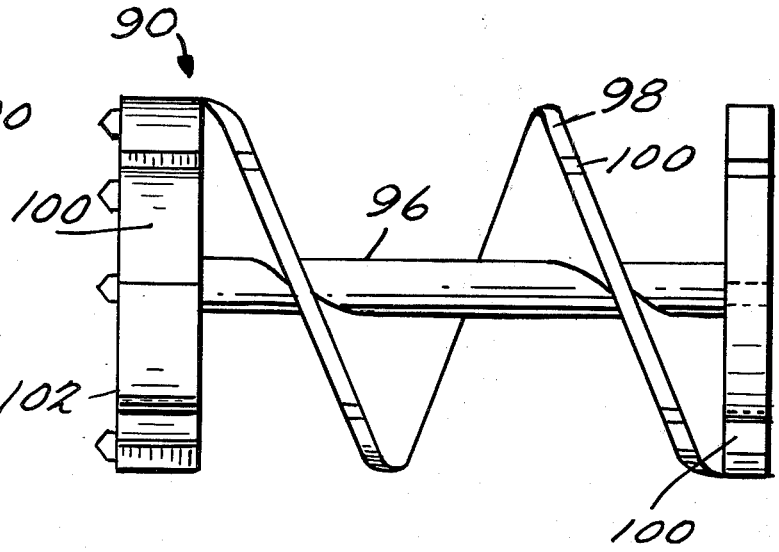
FIG. 6 is a view of an auger section of the preferred embodiment with the cutting head attached.

Looking at the entire cylindrical envelope of an auger section such as that shown in FIG. 6, a plurality of surface discontinuities 100 are provided therein which mate with corresponding discontinuities 65 in inner member 64 of the auger drive means 12. This permits the rotational torque necessary to provide the cutting action to the cutting head of the auger from the auger drive means, while allowing the auger to be pushed through the auger drive means by means of the auger advancing means 14. As mentioned above in connection with the description of the auger advancing means, a myrad of similar or equivalent gripping devices may be utilized to transmit the necessary torque from the auger drive means to the auger section. However, it is believed that this is one of the more efficient ways of doing so in view of the fact that it is also necessary to permit the auger section to be advanced through the auger drive means while the torque is being supplied to the auger. Any means which will permit these two functions would be equivalently satisfactory.

The auger cutting head 102 is here shown for example in FIG. 6, as being an integral portion of an auger section. This is not essential, however, and many auger cutting heads are available for attachment to a variety of auger sections and, thus, means may be provided for attaching a variety of such cutting heads to auger sections of the type designed to function in connection with the present invention. In any event, it is common to provide a plurality of cutting edges such as 104, in a predetermined arrangement about the front face of the cutting head, to provide the desired type of cutting action for the mineral being mined. Thus, the actual design of the cutting head attachment to the auger section does not form any part of this invention.

Referring now to the manner in which the invention operates, the entire mining device of the present invention can be transported to a mine entry where it is to be set up, preferably in the two sections, i.e. the auger drive means section 12 and the frame structure 10, which also includes the auger advancing means 14. This permits ease of movement of the two separate sections through the mine, particularly, where there are a large number of entries and interconnecting crosscuts and cross entries with relatively small space for maneuverability of long units. The two units, i.e. the auger drive means and frame structure, are then assembled at the desired location by use of the pin and clevice device on each side of the frame structure end auger device and by alignment of the spacer and alignment members 32 and 34 at the top of each unit.

Once the units are assembled, the adjustable bracing means 28 and 78 are adjusted to place the wedge members 24, 74 and 76 against the roof of the mine. In addition, they are adjusted to align the device so that when the auger is placed wherein it will be properly aligned with the face of the mine entry so that the auger hole produced thereby will extend in the desired direction relative to the mine entry, which is usually horizontal relative to the floor thereof.

In this initial set up position, the thrust member 46 should be positioned in its rear most location adjacent vertical support member 20 so that a first auger section either with or without a cutting head may be positioned in the auger drive means by inserting the auger section into the frame structure and sliding it through the inner driving member 64 of the auger drive means until it rests against the face of the entry being mined. At this point, assuming that not enough of the first auger section is extending rearward into the frame structure a sufficient distance to warrant the use of the auger advancing means 14, an additional auger section is secured to the rear portion of the first auger section and will then extend rearward into the frame structure. The thrust member is then adjusted forward by means of the variable speed gear motor until it contacts the rear portion of the last in place auger section. The cutting operation can then be commenced by turning on the power to the auger drive means and adjusting it to produce the desired cutting speed, i.e. rotational speed of the auger. As this is done, the variable speed gear motor is adjusted to advance the cutting head at the desired rate relative to the rotational speed of the auger due to the auger drive means. Once the proper setting is achieved the operation will continue automatically with the cutting head being advanced so as to stay in contact with the surface being mined while the necessary torque is supplied by the auger drive means.

Once the auger advancing means has advanced the last in place section of auger a sufficient distance forward in the frame structure to permit another auger section to be placed behind the previously inserted auger section, the operation is temporarily halted and the thrust member is returned to its rear most position by reverse operation of the variable speed gear motor. Once the next auger section is placed in position the thrust member is again advanced and the proper setting established on the auger drive means and auger advancing means to continue the proper advancement of the auger in relation to the face of the entry being mined, and the proper rate of cutting. This sequence of steps is continued until the desired depth of auger hole is achieved. Throughout this operation, due to the spiral nature of the auger, the coal or other mineral being mined is constantly fed rearward out to a position forward of and adjacent to the auger type mining device of the present invention, and is permitted to spill onto conventional conveyor apparatus 55 whereby it is conveyed from the surface being mined to a remote location by conventional apparatus not shown, where it can be properly processed.

Naturally, it is intended that a plurality of such mining devices as is disclosed herein can be utilized adjacent one another and in various stages of advancement. In fact, it is considered advantageous to use a plurality of these devices adjacent one another where there is sufficient surface to be mined with each device in various stages of operation, including some auger holes which have been drilled to their maximum desired depth. In this manner a large number of auger sections may be left in the previously drilled auger and each section may be removed and subsequently added to a mining device to permit the continuous mining and, thus, additional storage for auger section is unnecessary once such a routine is established.

Although the foregoing illustrates the preferred embodiment of the present invention and the manner in which it operates, it is noted that many variations are possible. All such variations as would be obvious to one skilled in this art are intended to be within the scope of the invention as defined by the following claims.

What is claimed is:

1. A mining device utilizing an auger which can be increased in length by securing additional sections of auger to the rear portion of the advancing auger so as to extend the cutting head of the auger into a seam of coal or the like being mined, for a greater distance than would otherwise be possible, comprising:

a rigid frame structure;

adjustable bracing means attached to the rigid frame structure for securing the device in place in relation to a surface from which the mining is to take place;

auger drive means for rotatably driving the auger, having an outer casing rigidly secured to the front portion of the frame structure, an inner driving member rotatably mounted within the casing and engageable with the outer peripheral portion of an auger the outermost extremities of which are generally defined by a cylindrical envelope;

motor means associated with the inner driving member for providing the rotational torque necessary to drive the auger including, a stator portion of an electric motor insulated from, secured to and contained within the casing of the auger drive means in concentric relation to the auger, a rotor portion of an electric motor insulated from and attached to the inner drive member of the auger drive means and disposed circumferentially about the auger in driven relationship to the stator portion;

auger advancing means having a variable speed motor mounted on the rear portion of the frame structure, at least one threaded rotatable auger advancing shaft driven by the variable speed motor and a thrust member having a threaded portion in engagement with the threads of the at least one threaded shaft and adapted for driving engagement with the rear portion of the auger the thrust member being movable between (1) a rearward position which is at least one auger length from the rearmost portion of the auger drive means and (2) a forward position which is at least as far forward as the rearmost portion of the auger drive means, so that when the thrust member is in the rearmost position an additional auger section may be attached to the rear of a previously inserted auger section and fed through the auger drive means by the thrust member.

2. A mining device as defined in claim 1 in combination with an auger means for forming a cylindrical auger hole extending into the seam being mined, having releasably inter-engaging auger sections of a spiral configuration the outermost extremities of the spiral being generally defined by a cylindrical envelope and which sections are rigidly securable to the rear end portion of a prior section, the outer extremities of the spiral further having a plurality of spaced discontinuities providing bearing surfaces in the tangential direction from the axis of the cylindrical envelope.

3. A mining device as defined in claim 1 wherein the auger drive means includes:

the casing being rigidly detachably secured to the frame structure with internal surfaces defining a cylindrical opening with a diameter greater than the diameter of the auger;

the inner driving member having gripping means disposed in spaced circumferentially surrounding relation to the auger for engagement therewith so as to rotate the auger and transmit the necessary rotational torque to the cutting head.

4. A mining device as defined in claim 1 wherein the casing of the auger drive means is rigidly detachably secured at a rear portion thereof to a front portion of the frame structure and additional adjustable bracing means for rigidly bracing the mining device in relation to the seam of coal being mined, are secured to the casing, at least one on each side thereof.

5. A mining device as defined in claim 4, wherein the adjustable bracing means includes a bracing member secured to the lower central rear portion of the frame structure for pivotal movement in a vertical plane, and the additional adjustable bracing means each includes a bracing member secured to the lower side portion of the casing, all of the bracing members combined being capable of supporting the weight of the mining device and wedging the upper portion of the frame structure and casing against the ceiling so as to prevent movement of the mining device relative to the vane during the mining operation.

6. A mining device as defined in claim 1 wherein the frame structure includes:

front and rear vertical end supports spaced apart a distance greater than the length of an auger section;

at least two horizontally spaced support members secured to an extending between the vertical end supports; and the front support having attachment means for releasably securing the casing of the auger drive means thereto.

7. A mining device as defined in claim 6 wherein the frame structure further includes a base plate in the form of a trough disposed below the auger between the vertical end supports and having a slit in the bottom thereof permitting mined spillage to pass therethrough.

8. A mining device as defined in claim 1 wherein the auger advancing means includes:

a speed reduction device secured to an output shaft of the motor and to a first auger advancing shaft;

a second auger advancing shaft horizontally spaced from the first;

the thrust member having threaded portions in engagement with the threads of the first and second auger advancing shaft and having a thrust bearing mounted thereon and engageable with the rear portion of the auger.

9. A mining device utilizing an auger which can be increased in length by securing additional sections of auger to the rear portion of the advancing auger so as to extend the cutting head of the auger into a seam of coal or the like being mined, for a greater distance than would otherwise be possible, comprising:

a rigid frame structure having a base plate, at least two horizontally spaced support members and front and rear vertical end supports, the base plate and the horizontal support members being rigidly secured to and extending between the vertical end supports, the end supports being spaced apart at least a sufficient distance to permit a length of the additional auger section to be passed therebetween so as to permit the section to be secured to the rear portion of the auger being advanced;

adjustable bracing means attached to the rigid frame structure for securing the device in place in relation to a surface from which the mining is to take place;

auger drive means for drivingly engaging the auger, having a casing portion rigidly detachably secured to the frame structure with internal surfaces defining a cylindrical opening with a diameter greater than the diameter of the auger, a stator portion of an electric motor insulated from and contained within the casing portion in concentric relation to the opening therein, an inner driving member adapted to engage the outer peripheral portion of an auger the outermost extremities of which are generally defined by a cylindrical envelope, a rotor portion of an electric motor insulated from and secured to the inner driving member and disposed circumferentially about the auger and in driven relationship to the stator portion; and auger advancing means for drivingly engaging the rear portion of the auger to cause the auger to advance at a predetermined rate so as to maintain the cutting head of the auger in contact with the surface being mined, the auger advancing means having a variable speed motor having a power output shaft and mounted on the rear portion of the frame structure, a speed reduction device secured to the output shaft, a threaded rotatable auger advancing shaft in driven engagement with the speed reduction device and a thrust member having a threaded portion in engagement with the threaded rotatable auger advancing shaft and adapted to drivingly engage the rear portion of the auger so as to advance the auger forward the thrust member being movable between (1) a rearward position which is at least one auger length from the rearmost portion of the auger drive means and (2) a forward position which is at least as far forward as the rearmost portion of the auger drive means, so that when the thrust member is in the rearmost position an additional auger section may be attached to the rear of a previously inserted auger section and fed through the auger drive means by the thrust member.

10. A mining device as defined in claim 9, wherein the adjustable bracing means includes:

at least one adjustable lower bracing member the upper portion of which is pivotally secured to the lower portion of the rear end support and the lower portion of which is adapted to engage the floor of a mine shaft;

two adjustable upper bracing members secured in vertical spaced relation to the upper portion of the rear end support and engageable with the ceiling of the mine shaft;

at least one additional adjustable bracing member disposed on each side of and secured to the lower portion of the casing portion of the auger drive means; and at least one upwardly extending protuberance on each side of the upper portion of the casing portion.

11. A mining device as defined in claim 9 wherein the inner driving member includes gripping means disposed in spaced circumferential surrounding relation to the auger for engagement therewith so as to rotate the auger and transmit the necessary forces to the cutting head.

12. A mining device as defined in claim 9 wherein the adjustable bracing means includes:

a bracing member secured to the lower central rear portion of the frame structure for pivotal movement in a vertical plane; and additional adjustable bracing means at least one of which is secured to each side of the casing portion and each includes a bracing member secured to the lower side portion of the casing portion;

all of the bracing members combined being capable of supporting the weight of the mining device and wedging the upper portion of the frame structure and casing portion against the ceiling so as to prevent movement of the mining device relative to the vane during the mining operation.

13. A mining device utilizing an auger which can be increased in length by securing additional sections of auger to the rear portion of the advancing auger so as to extend the cutting head of the auger into a seam of coal or the like being mined, for a greater distance than would otherwise be possible, comprising:

a rigid frame structure with front and rear vertical end supports disposed apart a distance greater than the length of a section of auger, and a plurality of spaced support members securing the end supports together, auger drive means, for rotatably driving the auger having an outer casing rigidly detachably secured to the front end support of the frame structure, an inner driving member rotatably mounted within the casing and engageable with the outer peripheral portion of an auger the outermost extremities of which are generally defined by cylindrical envelope;

motor means associated with the inner driving member for providing the rotational torque necessary to drive the auger including, a stator portion of an electric motor insulated from, secured to and contained within the casing of the auger drive means in concentric relation to the auger, a rotor portion of an electric motor insulated from and attached to the inner drive member of the auger drive means and disposed circumferentially about the auger in driven relationship to the stator portion;

auger advancing means having a variable speed motor mounted on the rear portion of the frame structure, at least one threaded rotatable auger advancing shaft driven by the variable speed motor and a thrust member having a threaded portion in engagement with the threads of the at least one threaded shaft and adapted for driving engagement with the rear portion of the auger, the thrust member being movable between (1) a rearward position which is at least one auger length from the rearmost portion of the auger drive means and (2) a forward position which is at least as far forward as the rear most portion of the auger drive means, so that when the thrust member is in the rearmost position and additional auger section may be attached to the rear of a previously inserted auger section and fed through the auger drive means by the thrust member; and adjustable bracing means having at least one adjustable bracing member secured to the lower portion of the rear vertical end support and at least one adjustable bracing member secured to each side of the casing portion of the auger drive means, the adjustable bracing means being sufficiently adjustable to cause upper portions of the frame structure and auger drive means to contact the roof of the mine and thereby brace the mining device sufficiently to prevent substantial movement of the device during the mining operation.

14. A mining device as defined in claim 13 wherein the auger drive means includes:

the casing being rigidly detachably secured to the frame structure with internal surfaces defining a cylindrical opening with a diameter greater than the diameter of the auger; and the inner driving member having gripping means disposed in spaced circumferentially surrounding relation to the auger for engagement therewith so as to rotate the auger and transmit the necessary rotational torque to the cutting head.

15. A mining device as defined in claim 13 wherein the auger advancing means includes:

a speed reduction device secured to an output shaft of the motor and to a first auger advancing shaft;

a second auger advancing shaft horizontally spaced from the first;

the thrust member having threaded portions in engagement with the threads of the first and second auger advancing shaft and having a thrust bearing mounted thereon and engageable with the rear portion of the auger.

16. A mining device as defined in claim 13 in combination with an auger means for boring a cylindrical auger hole extending into the seam being mined, having releasably inter-engaging auger sections of a spiral configuration the outermost extremities of the spiral being generally defined by a cylindrical envelope and which sections are rigidly securable to the rear end portion of a prior section, the outer extremities of the spiral having a plurality of spaced discontinuities providing bearing surfaces in the tangential direction from the axis of the cylindrical envelope.

17. A mining device utilizing an auger which can be increased in length by securing additional sections of auger to the rear portion of the advancing auger so as to extend the cutting head of the auger into a seam of coal or the like being mined, for a greater distance than would otherwise be possible, comprising:

a rigid frame structure;

adjustable bracing means attached to the rigid frame structure for securing the device in place in relation to a surface from which the mining is to take place;

auger means for boring a cylindrical auger hole extending into the seam being mined, having releasably interengaging auger sections of a spiral configuration the outermost extremities of the spiral being generally defined by a cylindrical envelope and which sections are rigidly securable to the rear end portion of a prior section, the outer extremities of the spiral having a plurality of spaced discontinuities providing bearing surfaces in the tangential direction from the axis of the cylindrical envelope;

auger drive means for rotatably driving the auger, having an outer casing rigidly secured to the frame structure, an inner driving member rotatably mounted within the casing and having portions mating with the bearing surfaces on the auger;

motor means associated with inner driving member for providing the rotational torque necessary to drive the auger including, a stator portion of an electric motor insulated from, secured to and contained within the casing of the auger drive means in concentric relation to the auger, a rotor portion of an electric motor insulated from and attached to the inner drive member of the auger drive means and disposed circumferentially about the auger in driven relationship to the stator portion; and auger advancing means having a variable speed motor mounted on the rear portion of the frame structure, at least one threaded rotatable auger advancing shaft driven by the variable speed motor, and a thrust member having a threaded portion in engagement with the threads of the at least one threaded shaft and adapted for driving engagement with the rear portion of the auger, the thrust member being movable between (1) a rearward position which is at least one auger length from the rearmost portion of the auger drive means and (2) a forward position which is at least as far forward as the rearmost portion of the auger drive means, so that when the thrust member is in the rearmost position an additional auger section may be attached to the rear of a previously inserted auger section and fed through the auger drive means by the thrust member.

18. A mining device as defined in claim 17 wherein the auger drive means includes:

the casing being rigidly detachably secured to the frame structure with internal surfaces defining a cylindrical opening with a diameter greater than the diameter of the auger;

the inner driving member having gripping means disposed in spaced circumferentially surrounding relation to the auger for engagement therewith so as to rotate the auger and transmit the necessary rotational torque to the cutting head.

19. A mining device as defined in claim 17 wherein the casing of the auger drive means is rigidly detachably secured at a rear portion thereof to a front portion of the frame structure and additional adjustable bracing means for rigidly bracing the mining device in relation to the seam of coal being mined, are secured to the casing, at least one on each side thereof.

20. A mining device as defined in claim 19 wherein the adjustable bracing means includes a bracing member secured to the lower central rear portion of the frame structure for pivotal movement in a vertical plane, and the additional adjustable bracing means each includes a bracing member secured to the lower side portion of the casing, all of the bracing members combined being capable of supporting the weight of the mining device and wedging the upper portion of the frame structure and casing against the ceiling so as to prevent movement of the mining device relative to the seam during the mining operation.

21. A mining device as defined in claim 17 wherein the frame structure includes:

front and rear vertical end supports spaced apart a distance greater than the length of an auger section;

at least two horizontally spaced support members secured to and extending between the vertical end supports; and the front support having attachment means for releasably securing the casing of the auger drive means thereto.

22. A mining device as defined in claim 21 wherein the frame structure further includes a base plate in the form of a trough disposed below the auger between the vertical end supports and having a slit in the bottom thereof permitting mined spillage to pass therethrough.

* * * * *